United States Patent [19]

Bauer

[11] 4,037,837

[45] July 26, 1977

[54] METHOD OF PLAYING BASEBALL

[76] Inventor: William Bauer, 212 Forester, El Campo, Tex. 77437

[21] Appl. No.: 626,256

[22] Filed: Oct. 28, 1975

[51] Int. Cl.[2] ..... A63B 71/00

[52] U.S. Cl. ..... 273/25; 273/95 H; 272/3

[58] Field of Search ..... 273/95 H, 1.5 R, 25; 272/3

[56] References Cited

U.S. PATENT DOCUMENTS

| | | | |
|---|---|---|---|
| 2,785,897 | 3/1957 | Lennon | 273/25 |
| 3,002,234 | 10/1961 | Waterbury | 272/3 X |

*Primary Examiner*—Richard C. Pinkham
*Assistant Examiner*—T. Brown
*Attorney, Agent, or Firm*—Kenneth H. Johnson; N. Elton Dry

[57] ABSTRACT

An improved baseball field for use by different forms or classes of players wherein a conventional baseball field has designated thereon a first field area used by one form and a second field area designated for use by a second form werein each of two teams have members of both forms on said teams such that the members of the two forms on one team play together in a cooperative manner. The game played on the improved baseball field is substantially the same game as played on conventional fields.

6 Claims, 2 Drawing Figures

METHOD OF PLAYING BASEBALL

BACKGROUND OF THE INVENTION

The present invention relates to an improved apparatus on which to play a baseball game and the improved game played on the improved apparatus.

The present apparatus comprises an infield and an outfield, a home plate, three bases, a pitcher's mound, base lines and foul lines. The field may be the same size or substantially the same size field previously employed in baseball.

Currently there are many organizations and a great deal of pressure towards obtaining equal treatment between male and female. Some of the more vocal organizations have urged that the young male members of our society are allowed to compete in games such as baseball which develop the proper spirit of competitiveness which is ultimately necessary for these youngsters to succeed in business or the more competitive world and young females are denied their opportunity to compete in the same environment with the males and are thereby denied to come to understand their potential competitors in adult life. Since many of these sports are contact sports such as baseball, wherein it would be eminently unfair to put females against males on an equal physical level, young girls are deprived of the competitive experience, and thereby enter into adulthood at a disadvantage to their male peers. Hence, the female is held at a disadvantage even when job opportunities are made available to her.

The disparity between the physical development of males and females of peer groups is an accepted and established medical fact. In early childhood up through adolescence there is less of a physical difference, however even in these early years the male members of the peer group tend to have more muscular and different development than the female members. Similarly, after adolescence the male members of the group develop substantially more muscular physiques with or without particular effort in so doing, than the female members of the peer group, which would make any organized or direct physical competition directly between members of this older group completely unrealistic and eminently unfair to the female participants.

However, if there is any merit to the contention of those who hold to the belief the lack of competition by the female members of the peer group during this formative age in the competitive hard driving sports game, puts them at a disadvantage, and it would seem that this is logical, since environment is an accepted factor in determining an individual's approach to life and lifestyle, it would appear that there must be some way to directly involve the females in the peer group directly in the highly competitive type sport in which the male members participate, without emphasizing the physical disparity between the two groups.

It is a feature of the present invention that a baseball game is playable on an adapted baseball field wherein different classes of participants may play on each team in accordance with substantially the same rules as prior art baseball is played.

It is a further feature of the present invention that direct body contact between participants of different classes of skill or ability or physical characteristics is minimized or avoided entirely yet the element of competition and participation of the members of different classes is retained.

It is a particular advantage of the present invention that males and females may play on the same team, on the same field in the same game against a similarly constituted team.

It is further an advantage of the present game that younger and older participants may play on the same field in the same game and under the same rule against a similarly constituted team.

It is particularly a feature of the present invention that the one class of players may still play the game of baseball on substantially the same field and in substantially the same manner as before, and a second class of players will provide a supporting and additive role to the players of the first class or form.

A further feature of the present invention is members of different groups participate and enter into the competition with each other, while not making either group feel that it is inferior or being subjected to reverse discrimination by being forced into competition with the first group directly, thus the degree of competition which may be useful between males and females, can be achieved without the unnecessary antagonization of those who hold other views.

DRAWINGS

SUMMARY OF THE INVENTION

Figure 1:
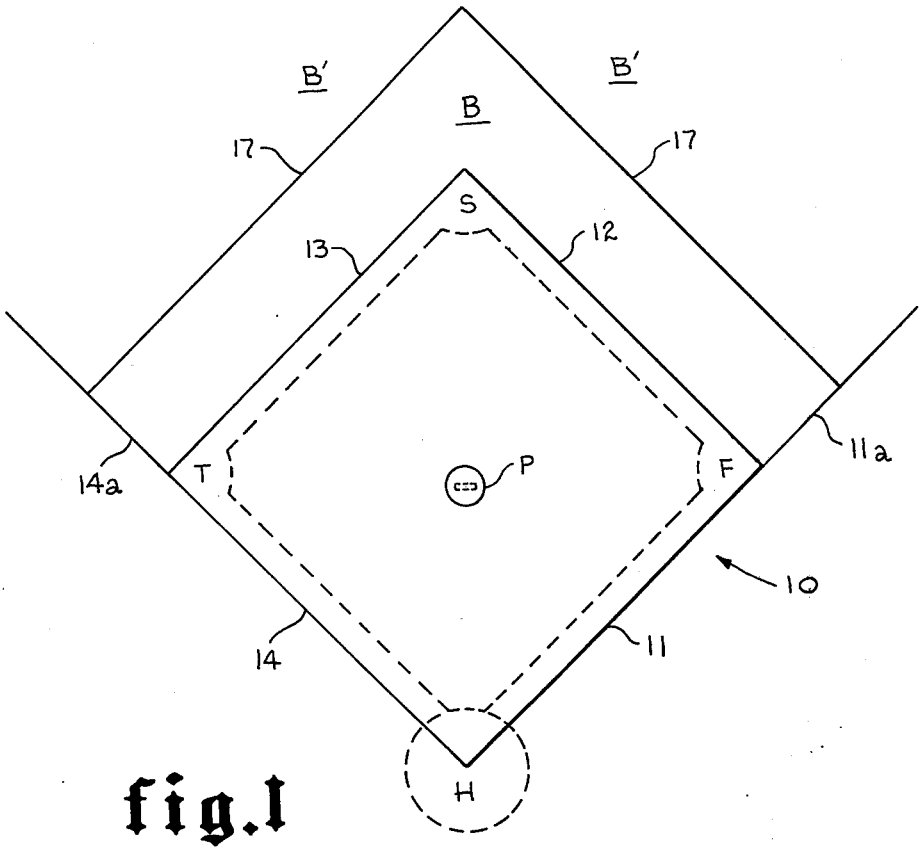
FIG. 1 is a top view of a baseball field showing two embodiments of the present invention, wherein a portion of the outfield is restricted to one form of players.

Briefly stated the invention is in a baseball apparatus wherein the improvement comprises having a first designated field area and a second designated field area, said baseball field being adapted for use by a team having a plurality of members divided into two forms, one form being assigned to each of said designated field areas. A first designated area may comprise the entire field, and a second designated are comprises less than said entire field and may be within said the first designated area such that members of the form assigned to play on said first area may also play in said second area and members of the form assigned to play in said second area are restricted to said second area.

More specifically the present invention relates to an improvement in baseball field apparatus for use in playing the sport baseball, comprising a baseball field having an infield, and an outfield, foul lines, base lines, a home plate, a first base, a second base, a third base and pitcher's mound, wherein the improvement comprises designating a first area of said field and a second area of said field said second area comprising less than 50% of the field said baseball field being adapted for use by a team comprising a plurality of members and two forms having one or more members, whereby the members of said form assigned to said second area will be restricted for the purposes of playing baseball, to said second area. The designated area for said second area does not need to be continuous.

The second area preferably comprises less than 40% of the area of the baseball field. Hence, the players in the form assigned to the first area will comprise the major number of players and comprise the central part of the baseball game and will not be restricted to that portion or area but may play over the entire field in the usual manner of baseball. The second designated area, i.e., the smaller area will have form members who provide a supportive roll to those in the form assigned to the first designated area. For example, if the major or first form were composed of males of 16 to 19 years of age, males of 10–15 years age could provide the supporting members of the second form, yet the central quality of the game would not deteriorate or slow down. Similarly the second form could be comprised of female team members. The apparatus and game of the present invention could just as well be played with the younger or female members in the first, i.e., major form and first designated area, with the older male players in the second form and second minor area, i.e., supportive roll.

The term "form" as used herein means a group, class or designated members of a team which will play on one of the two designated areas of the improved baseball field described herein.

DETAILED DESCRIPTION OF THE INVENTION AND PREFERRED EMBODIMENTS

The baseball field apparatus in the present invention is not limited to fields of any particular size, although it is contemplated that the present baseball field as employed, for example by the NCAA or various high school associations, will be employed for the overall dimensions of the present field such as whitewash applied to the field in the same manner as foul lines, base lines, and the like are currently applied. It is also contemplated within the scope of this invention that the various forms of bases and pitcher's mounds, batter's boxes and the like will be employed without any necessary change in the location or shape therein. Although certain shapes and/or area designation may be indicated as preferred, it is to be understood that the shape of the designated areas may be rectangular, triangular, elliptoid, irregular or regular for example. A principle consideration in the present invention in designating the area which has been described above as the minor portion of the field is that the players assigned to the entire field can substantially play the same game of baseball as played in the prior art, with the second designated area and the form the players are assigned thereto, being there in a supportive manner. The present invention may be more readily understood in reference to the drawing.

FIG. 1 is a top view of a baseball field, which is substantially the same as a prior art baseball field, however in addition to the base line 11, 12, 13 and 14 connecting home plate (H), first base (F) second base (S), and third base (T), respectively; foul lines 11—11*a*, 14–14*a*, there is is a boundary line 17, which is a division designating the minor portion of the field, B or B′ in the outfield area. In one embodiment the minor portion B extends from the boundary lines 17 to the base lines 12 and 13. In another embodiment represented by FIG. 1, the minor area B′ begins with the line 17 and comprising approximately two-thirds or less of the outfield.

Figure 2:
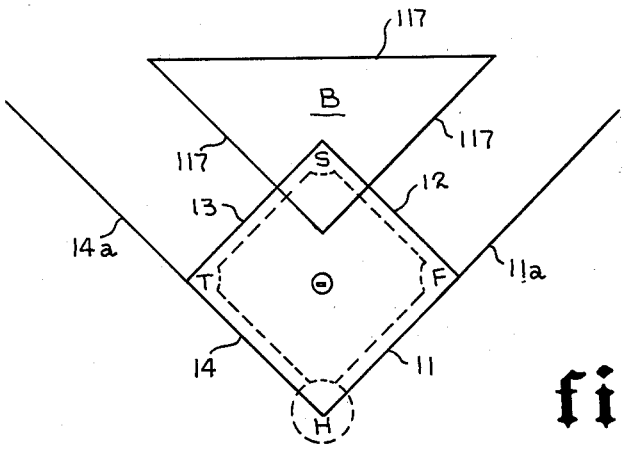
FIG. 2 is a top view of a baseball field showing an alternative embodiment of the present invention wherein a portion of the infield and outfield are restricted to one form of players.

In FIG. 2, an alternative embodiment is shown wherein the B zone comprises a triangular section of the baseball field including second base and a portion of the outfield and being bounded by boundary line 117. Similar line designations are used for the base lines and foul lines as used in FIG. 1.

The purpose of the boundary lines dividing the field is to provide an area for the supportive players to be able to aid and support the principle players. It is intended that the supportive players be assigned to the smaller portion of the field will be limited to that portion whereas the players assigned to the major portion of the field will be able to cross into the smaller portion of the field. For example, in regard to FIG. 1 the embodiment wherein the B area is designated by the baselines 12 and 13 and the boundary line 17, the members of the team on the field assigned to the B form would not be allowed to enter into the infield or into the distant outfield, however, the players in the major form assigned to the entire field would be allowed to enter into the B area in the usual manner of baseball. Hence, by this arrangement, the principle players who are intended to carry the major portion of the game are not put into a position of watching out for the boundary lines and thereby detracting from the quality of their game, however the supportive players must be aware of these boundary lines, and stay within them and furthermore would be expected to support and not hinder the principle players.

It is anticipated that the size of the baseball teams would substantially be the same as presently constituted i.e., the form which plays on the major designated area of the field would contain 9 members and the second form which would provide as a supporting role would contain 2 to 4 members. Alternatively of course, the form playing on the major area of the field could have the number of players reduced by the number of players in the form assigned to the minor area to maintain 9 players on the field.

In one embodiment the game as played on the baseball field apparatus, the members of the supportive form, would not participate in the batting line up or would participate when they had participated in the prior inning in some manner in the field play. Alternatively, the members of both forms would be in the batting line-up in whatever order was designated by the manager of the team, as is presently done.

It is contemplated that the usual rules followed for any particular organization or group be followed when baseball is played according to the present modified game apparatus. The penalty for a player, assigned to the minor portion of the field, entering into the other portion of the field is the same as currently applied when too many players are on the field.

It is contemplated that the two teams will be constituted of the same number of members, and both have two forms, wherein each form of each team will have the same number of members. It is further contemplated that the members of forms of each team will be of the same group, class, grade, etc. so that the purposes and objectives of the present invention will be satisfied.

The invention claimed is:

1. In a method of playing baseball comprising two opposing teams, having a plurality of players wherein one team is at bat and one team is on the field, said field having an infield, an outfield, foul lines, base lines, a home plate, a first base, a second base, a third base, and pitcher's mound wherein the improvement comprises having a plurality of members on each of said opposing teams, each of said teams having two forms, each of said forms having one or more members, assigning members of one form on both teams to a first designated area of said field, said first designated area being generally coextensive with said infield, designating a second area comprising less than 50% of the said field, said second designated area having at least a major part thereof disposedin said outfield, assigning a first form to use said first area of said field when the team to which that form belongs is on said field, and designating a second form of said team to said second area of said field, said second form being assigned to said second area of the field being restricted to said second area of the field for the purposes of playing the game of baseball, and said members of the first form not being restricted, but being able to play on the entire field.

2. The method according to claim 1 wherein each team has the same number of players on each form.

3. The method of claim 1 wherein said designated second area of said field is indicated by a boundary indicated on said field.

4. The method of claim 1 wherein said second area comprises less then 40% of the area of the field.

5. The method of claim 4 wherein the second designated area is continuous.

6. The method of claim 1 wherein said second designated portion is symetrical and said field is symetrical.

* * * * *